US005228086A

United States Patent [19]

Morii

[11] Patent Number: 5,228,086

[45] Date of Patent: Jul. 13, 1993

[54] SPEECH ENCODING APPARATUS AND RELATED DECODING APPARATUS

[75] Inventor: Toshiyuki Morii, Tokyo, Japan

[73] Assignee: Matsushita Electric Industrial Co., Ltd., Osaka, Japan

[21] Appl. No.: 696,410

[22] Filed: May 6, 1991

[30] Foreign Application Priority Data

May 18, 1990 [JP] Japan ..... 2-129607
Sep. 18, 1990 [JP] Japan ..... 2-249441

[51] Int. Cl.[5] ..... G10L 5/00
[52] U.S. Cl. ..... 381/36; 381/38
[58] Field of Search ..... 381/29-38, 381/47-49; 395/2

[56] References Cited

U.S. PATENT DOCUMENTS 4,680,797 7/1987 Benke .
4,888,806 12/1989 Jenkin ..... 381/35
5,077,798 12/1991 Ichikawa ..... 381/36

FOREIGN PATENT DOCUMENTS 1296212 8/1967 Fed. Rep. of Germany .
2020517 11/1979 United Kingdom .

OTHER PUBLICATIONS

"The Vector Quantization of Waveform Framed by Pitch" by Y. Matsumura et al; Report from the Society of Electronics Communications; Jan. 30, 1987.
Electronics Letters, vol. 14, No. 15, Jul. 20, 1978, pp. 456-457, Stevenage, GB; R. A. King et al: "Time-encoded speech".
ICASSP '87 (1987 International Conference on Acoustics, Speech and Signal Processing, Dallas, Tex., Apr. 6-9, 1987), vol. 4, pp. 1949-1952, IEEE, New York, US; S. Roucos et al.: "A segment vocoder algorithm for real-time implementation".
ICASSP '81 (IEEE International Conference on Acoustics, Speech and Signal Processing, Atlanta, Ga., Mar. 30-Apr. 1, 1981), vol. 2, pp. 804-807, IEEE, New York, US; P. Mabilleau et al.: "Medium band speech coding using a dictionary of waveforms".
ICASSP '85 (IEEE International Conference on Acoustics, Speech and Signal Processing, Tampa, Fla., Mar. 26-29, 1985), vol. 1, pp. 236-239, IEEE, New York, U.S.; S. Roucos et al.: "The waveform segment vocoder: a new approach for very-low-rate speech coding".

*Primary Examiner*—Emanuel S. Kemeny
*Attorney, Agent, or Firm*—Lowe, Price, LeBlanc & Becker

[57] ABSTRACT

In a speech encoding apparatus, a pitch of an input speech signal is analyzed, and a basic waveform of one pitch of the input speech signal is derived. A number of a pair or pairs of pulse elements of a desired framework is decided, and the desired framework is generated in response to the basic waveform. The generated desired framework is encoded. An inter-element waveform code book contains predetermined inter-element waveform samples which are identified by different identification numbers. Inter-element waveforms which extend between the elements of the framework are encoded by use of the inter-element waveform code book.

12 Claims, 8 Drawing Sheets

FIG. 8

| INFORMATION | 1-DEGREE | 2-DEGREE | 3-DEGREE |
|---|---|---|---|
| PITCH INFORMATION | 7 | 7 | 7 |
| DEGREE INFORMATION | 2 | 2 | 2 |
| FRAMEWORK POSITION INFORMATION | 14 | 19 | 25 |
| FRAMEWORK GAIN INFORMATION | 14 | 26 | 26 |
| INTER-ELEMENT WAVEFORM INFORMATION | 24 | 30 | 30 |
| TOTAL | 61 | 74 | 90 |
| | (MAX 4.5kbps) | | |

FIG. 11

| INFORMATION | 1-DEGREE | 2-DEGREE | 3-DEGREE |
|---|---|---|---|
| PITCH INFORMATION | 7 | 7 | 7 |
| DEGREE INFORMATION | 2 | 2 | 2 |
| FRAMEWORK POSITION INFORMATION | 14 | 19 | 25 |
| FRAMEWORK GAIN INFORMATION | 14 | 26 | 26 |
| INTER-ELEMENT WAVEFORM INFORMATION | 24 | 30 | 30 |
| PARAMETER INFORMATION | 12 | 12 | 12 |
| TOTAL | 73 | 86 | 102 |

(MAX 5.1kbps)

SPEECH ENCODING APPARATUS AND RELATED DECODING APPARATUS

BACKGROUND OF THE INVENTION

This invention relates to an apparatus for encoding a speech signal, and also relates to a decoding apparatus matching the encoding apparatus.

Apparatus for encoding a speech signal at a low bit rate of about 4.8 kbps is usually one of two types, that is, a speech analysis and synthesis encoding type and a speech waveform encoding type. In the first type, frequency characteristics of a speech are extracted by a spectrum analysis such as a linear predictive analysis, and the extracted frequency characteristics and speech source information are encoded. In the second type, a redundancy of a speech is utilized and a waveform of the speech is encoded.

Prior art encoding of the first type is suited to the realization of a low bit rate but is unsuited to the encoding of a drive speech source for synthesizing a good-quality speech. On the other hand, prior art encoding of the second type is suited to the recovery of a good-quality speech but is unsuited to the realization of a low bit rate. Thus, either the prior art encoding of the first type or the prior art encoding of the-second type requires a compromise between a good speech quality and a low bit rate.

Further, either the prior art encoding of the first type or the prior art encoding of the second type tends to make processing complicated and thus to increase calculation steps.

SUMMARY OF THE INVENTION

It is an object of this invention to provide an improved speech encoding apparatus.

It is another object of this invention to provide an improved decoding apparatus.

A first aspect of this invention provides a speech encoding apparatus comprising means for analyzing a pitch of an input speech signal, and deriving a basic waveform of one pitch of the input speech signal; means for deciding a number of a pair or pairs of pulse elements of a desired frameword, and generating the desired framework in response to the basic waveform; means for encoding the generated desired framework; an inter-element waveform code book containing predetermined inter-element waveform samples which are identified by different identification numbers; and means for encoding inter-element waveforms which extend between the elements of the framework by use of the inter-element waveform code book.

A second aspect of this invention provides a decoding apparatus comprising means for decoding framework coded information into a framework composed of pulse elements; an inter-element waveform code book containing predetermined inter-element waveform samples which are identified by different identification numbers; and means for decoding inter-element waveform coded information into inter-element waveforms by use of the inter-element waveform code book, the inter-element waveforms extending between the elements of the framework.

A third aspect of this invention provides a speech encoding apparatus comprising means for deriving an average of waveforms within one pitches of an input speech signal which occurs during a predetermined interval; means for deciding a framework of the average one-pitch waveform, the framework being composed of elements corresponding to pulses respectively; means for encoding the framework; means for deciding inter-element waveforms in response to the framework, the inter-element waveforms extending between the elements of the framework; and means for encoding the inter-element waveforms.

A fourth aspect of this invention provides a speech encoding apparatus comprising means for deriving an average of waveforms within one pitches of an input speech signal which occurs during a predetermined interval; means for deciding a framework of the average one-pitch waveform, the framework being composed of elements corresponding to pulses respectively which occur at time points equal to time points of occurrence of minimal and maximal levels of the average one-pitch waveform, and which have levels equal to the minimal and maximal levels of the average one-pitch waveform; means for encoding the framework; means for deciding inter-element waveforms in response to the framework, the inter-element waveform extending between the elements of the framework; and means for encoding the inter-element element waveforms.

A fifth aspect of this invention provides a speech encoding apparatus comprising means for separating an input speech signal into predetermined equal-length intervals, executing a pitch analysis of the input speech signal for each of the analysis intervals to obtain pitch information, and deriving a basic waveform of a one-pitch length which represents the analysis intervals by use of the pitch information; means for executing a linear predictive analysis of the input speech signal, and extracting linear predictive parameters denoting frequency characteristics of the input speech signal for each of the analysis intervals; means for subjecting the basic waveform to a filtering process in response to the linear predictive parameters, and deriving a linear predictive residual waveform of a one-pitch length; means for deriving a framework denoting a shape of the predictive residual waveform, and encoding the derived framework, the framework being composed of elements corresponding sequential pulses of different types; an inter-element waveform code book containing predetermined inter-element waveform samples which are identified by different identification numbers; and means for encoding inter-element waveforms which extend between the elements of the framework by use of the inter-element waveform code book.

A sixth aspect of this invention provides a decoding apparatus comprising means for decoding framework coded information into a framework composed of elements corresponding sequential pulses; an inter-element waveform code book containing predetermined inter-element waveform samples which are identified by different identification numbers; means for decoding inter-element waveform coded information into inter-element waveforms by use of the inter-element waveform code book, and forming a basic predictive residual waveform, the inter-element waveforms extending between the elements of the framework; means for subjecting the basic predictive residual waveform to a filtering process in response to input parameters, and deriving a basic waveform of a one-pitch length; and means for retrieving a final waveform of a one-pitch length on the basis of the basic one-pitch waveform.

BRIEF DESCRIPTION OF THE DRAWINGS

FIG. 8 is a diagram showing details of an example of a bit assignment in the first embodiment of this invention.

FIG. 11 is a diagram showing details of an example of a bit assignment in the second embodiment of this invention.

DESCRIPTION OF THE FIRST PREFERRED EMBODIMENT

According to a first embodiment of this invention, a detection or calculation is made as to an average of waveforms within respective single pitches of an input speech signal which occur during a predetermined interval, and then a determination is made as to a framework (skeleton) of the average single- or one-pitch waveform. The framework is composed of elements (bones) corresponding to pulses which respectively occur at time points equal to time points of occurrence of minimal and maximal levels of the average one-pitch waveform, and which have levels equal to the minimal and maximal levels of the average one-pitch waveform. The framework is encoded. Inter-element waveforms are decided in response to the framework. The inter-element waveforms extend between the elements of the framework. The inter-element waveforms are encoded.

Figure 1:
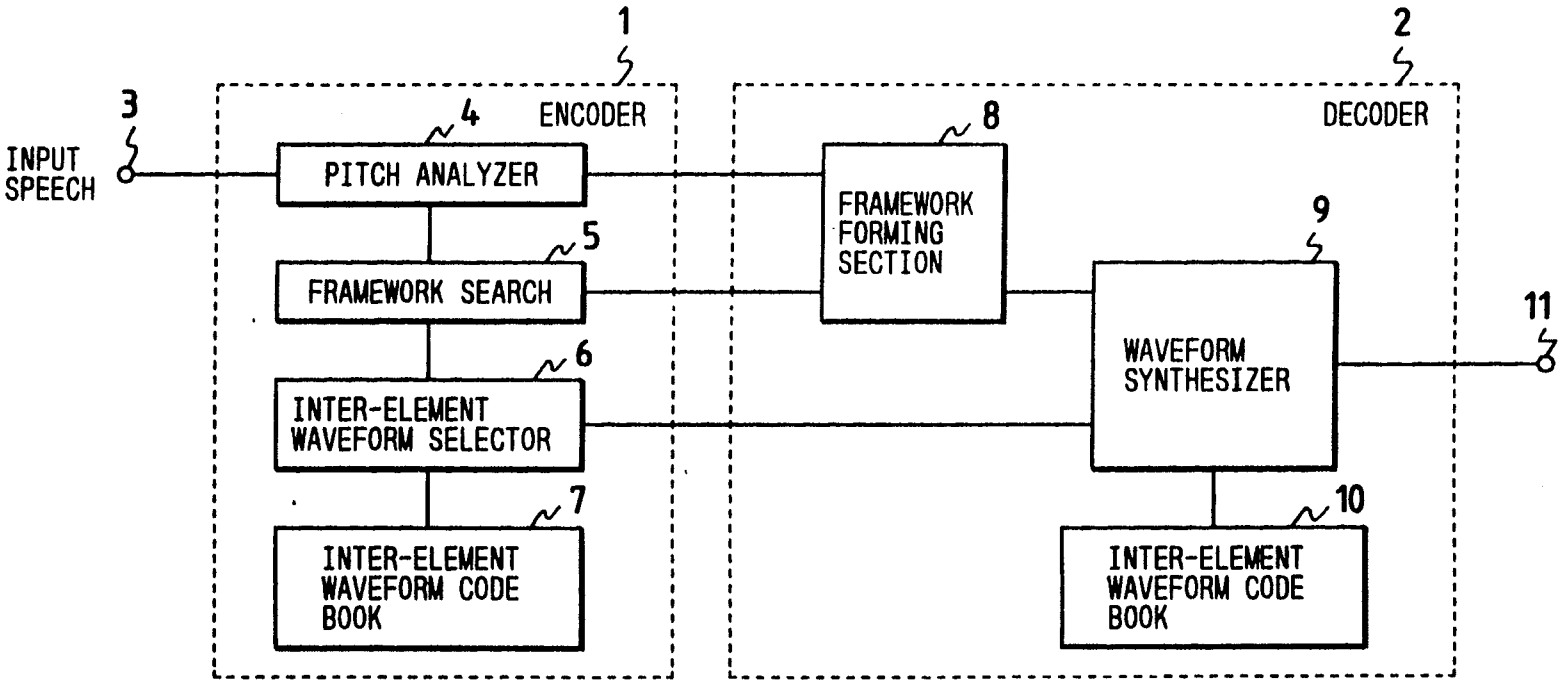
FIG. 1 is a block diagram of an encoder and a decoder according to a first embodiment of this invention.

The first embodiment of this invention will now be further described. With reference to FIG. 1, an encoder 1 receives a digital speech signal 3 from an analog-to-digital converter (not shown) which samples an analog speech signal, and which converts samples of the analog speech signal into corresponding digital data. The digital speech signal 3 includes a sequence of separated frames each having a predetermined time length.

The encoder 1 includes a pitch analyzer 4 which detects the pitch within each frame of the digital speech signal 3. The pitch analyzer 4 generates pitch information representing the detected pitch within each frame. The pitch analyzer 4 derives an average waveform of one pitch from the waveform of each frame. The pitch analyzer 4 feeds the derived average waveform to a framework search section 5 within the encoder 1 as a basic waveform.

The framework search section 5 analyzes the shape of the basic waveform, and decides what degree a framework (skeleton) to be constructed has. The degree of a framework is defined as being equal to a half of the total number of elements (bones) of the framework. It should be noted that the elements of the framework form pairs as will be made clear later. The framework search section 5 searches signal time points, at which the absolute value of positive signal data and the absolute value of negative signal data are maximized, in dependence on the degree of the framework. The framework search section 5 defines the searched signal points and the related signal values as framework information (skeleton information). The searched signal points in the framework information agree with the time points of the elements of the framework, and the related signal values in the framework information agree with the heights of the elements of the framework. The elements of the framework agree with pulses corresponding to peaks and bottoms of the basic waveform. In summary, the basic waveform is transformed into a framework, and the framework is encoded into framework information.

A further description will now be given of the framework search section 5. Basic waveforms of one pitch are similar to signal shapes related to an impulse response. The basic waveform of one pitch depends on the speaker and speaking conditions. Thus, in order to represent a basic waveform of one pitch by a framework, it is necessary to previously decide the degree of the framework, that is, the number of the elements of the framework, in dependence on the characteristics of the basic waveform. For example, the degree of the framework or the number of the elements of the framework is set small for a basic waveform similar to a gently-sloping hill. The degree of the framework or the number of the elements of the framework is set large for a basic waveform in which a signal value frequently moves up and down.

The framework search section 5 includes a digital signal processor having a processing section, a ROM, and a RAM. The framework search section 5 operates in accordance with a program stored in the ROM. This program has a segment for the search of a framework. By referring to the framework search segment of the program, the framework search section 5 executes steps (1)–(8) indicated later. In the description of the framework search segment of the program: Xi(i=1, L) denotes signal values of different signal positions which compose a basic waveform of one pitch where i represents a signal position varying from 1 to L, and L represents the time length of the basic waveform; D denotes a maximal degree of a framework; K denotes a set of ranges of the inhibition of search where elements of the set are represented by the positions 1 to L; M denotes the number of the times of the execution of a given part of the search; and Hi denotes framework information which is defined as "Hi=(Ax, An, Ix, In)" where Ax represents a maximal signal value, An represents a minimal signal value, Ix represents a signal position at which the maximal signal value Ax occurs, and In represents a signal position at which the minimal signal value An occurs.

(1) Initialization is done, and initial values are set. Specifically, the set K is initialized as "K=Ko" where Ko denotes a null set. The search execution number M is initialized to 0. The step (1) is followed by the step (2).

(2) The search execution number M is updated as "M=M+1". The step (2) is followed by the step (3).

(3) A maximal signal value Xmax and a minimal signal value Xmin are decided as follows.

$$Xmax=\max\{Xi;\ i=1,\ LiK\}=Xi1$$

$$Xmin=\min\{Xi;\ i=1,\ LiK\}=Xi2$$

In addition, framework information HM is decided as follows.

$$HM=(Xmax, Xmin, i1, i2)$$

The step (3) is followed by the step (4).

(4) A detection is made as to positions of intervals which are centered at the positions i1 and i2, and in which the signs of the signal values Xi do not change. The detected positions are added into the set K as set elements representing inhibition ranges. The step (4) is followed by the step (5).

(5) A decision is made as to whether or not the search execution number M equals the maximal framework degree. In addition, a decision is made as to whether or not the set K contains all the positions 1 to L. When the search execution number M equals the maximal framework degree, or when the set K contains all the positions 1 to L, the step (5) is followed by the step (6). Otherwise, a return to the step (2) is done.

(6) The position information is extracted from the framework information Hj(j=1, M), and the extracted positions are arranged according to magnitude, that is, according to time base direction. The step (6) is followed by the step (7).

(7) The positions extracted in the step (6) are checked sequentially in the order from the smallest to the greatest. Specifically, a check is made as to whether each extracted position agrees with a position at which the maximal signal value or the minimal signal value occurs, that is, whether or not each extracted position corresponds to the maximal signal value or the minimal signal value. When two successive positions correspond to the maximal signal values, or when two successive positions correspond to the minimal signal values, the search execution number M is decremented as "M=M−1" and then a return to the step (6) is done. When the extracted positions corresponding to the maximal signal values alternate with the extracted positions corresponding to the minimal signal values, the step (7) is followed by the step (8). Also, when the extracted position corresponding to the maximal signal value alternates with the extracted position corresponding to the minimal signal value, the step (7) is followed by the step (8). (8) The search execution number M is defined as a final framework degree. The framework information Hj(j=1, M) is defined as final framework information. The search is ended.

Figure 2:
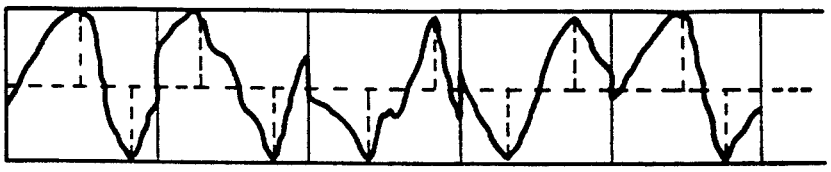
FIGS. 2–4 are time-domain diagrams showing examples of basic waveforms and frameworks in the first embodiment of this invention.
Figure 3:
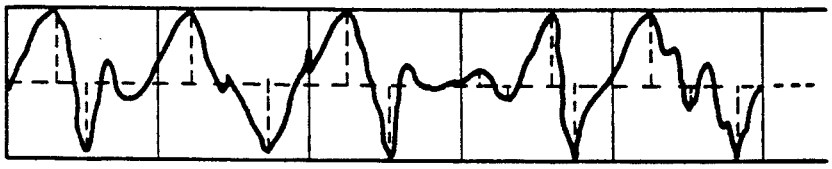
Figure 4:
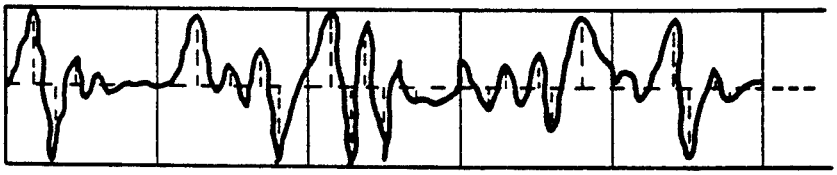

FIGS. 2–4 show examples of basic waveforms of one pitch and framework information obtained by the framework search section 5. In FIGS. 2–4, solid curves denote basic waveforms of one pitch while vertical broken lines denote framework information including maximal and minimal signal values, and signal points at which the maximal and minimal signal values occur. In the example of FIG. 2, the framework degree is equal to 1. In the example of FIG. 3, the framework degree is equal to 2. In the example of FIG. 4, the framework degree is equal to 3.

Figure 5:
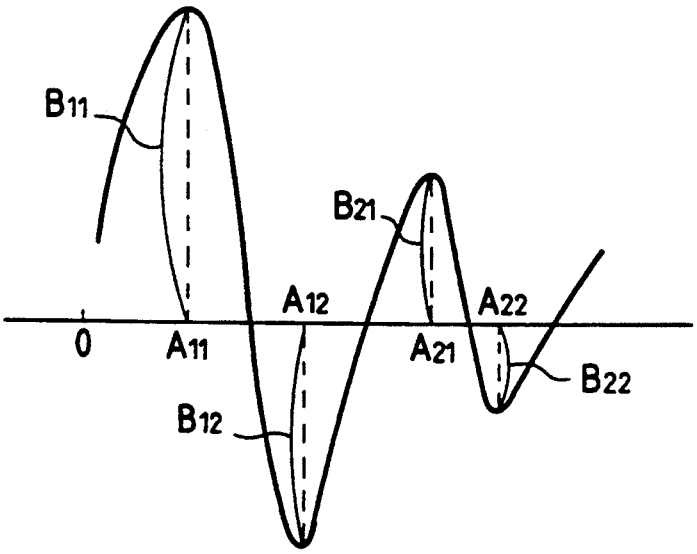
FIG. 5 is a time-domain diagram showing an example of a basic waveform and a framework in the first embodiment of this invention.

FIG. 5 more specifically shows an example of a basic waveform and framework information obtained by the framework search section 5. In FIG. 5, the characters A11, A12, A21, and A22 denote the framework position information, and the characters B11, B12, B21, and B22 denote the framework signal value information.

Figure 6:
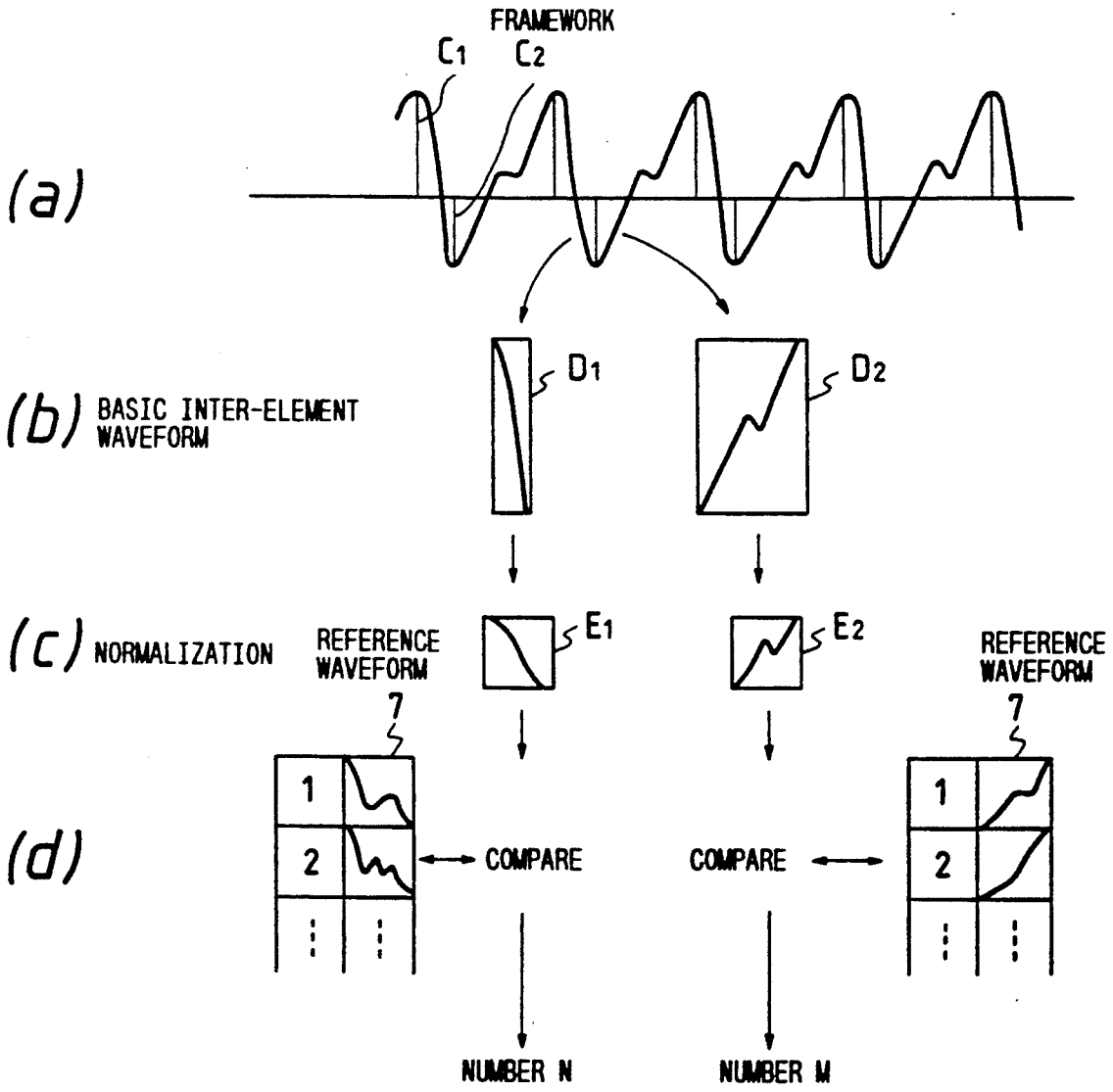
FIG. 6 is a diagram showing examples of processes executed in the encoder of FIG. 1.

The encoder 1 includes an inter-element waveform selector 6 which receives the framework information from the framework search section 5. The inter-element waveform selector 6 includes a digital signal processor having a processing section, a ROM, and a RAM. The inter-element waveform selector 6 executes hereinafter-described processes in accordance with a program stored in the ROM. A detailed description will now be given of the inter-element waveform selector 6 with reference to FIG. 6 which shows an example with a framework degree equal to 1. Firstly, the inter-element waveform selector 6 decides basic inter-element waveforms D1 and D2 within one pitch on the basis of the framework information fed from the framework search section 5. The basic inter-element waveform D1 agrees with a waveform segment which extends between the points of a maximal value signal C1 and a subsequent minimal value signal C2. The basic inter-element waveform D2 agrees with a waveform segment which extends between the points of the minimal value signal C2 and a subsequent maximal value signal C1. Secondly, the basic inter-element waveforms D1 and D2 are normalized in time base and power into waveforms E1 and E2 respectively. During the normalization, the ends of the waveforms D1 and D2 are fixed.

The inter-element waveform selector 6 compares the normalized waveform E1 with predetermined inter-element waveform samples which are identified by different numbers (codes) respectively. By referring to the results of the comparison, the inter-element waveform selector 6 selects one of the inter-element waveform samples which is closest to the normalized waveform E1. The inter-element waveform selector 6 outputs the identification number (code) N of the selected inter-element waveform sample as inter-element waveform information. Similarly, the inter-element waveform selector 6 compares the normalized waveform E2 with the predetermined inter-element waveform samples. By referring to the results of the comparison, the inter-element waveform selector 6 selects one of the inter-element waveform samples which is closest to the normalized waveform E2. The inter-element waveform selector 6 outputs the identification number (code) M of the selected inter-element waveform sample as inter-element waveform information.

The inter-element waveform samples are stored in an inter-element waveform code book 7 within the encoder 1, and are read out by the inter-element waveform selector 6. The inter-element waveform code book 7 is formed in a storage device such as a ROM. The inter-element waveform samples are predetermined as follows. Various types of speeches are analyzed, and basic inter-element waveforms of many kinds are obtained. The basic inter-element waveforms are normalized in time base and power into inter-element waveform samples which are identified by different numbers (codes) respectively.

The inter-element waveform code book 7 will be further described. As the size of the inter-element waveform code book 7 increases, the encoding signal distortion decreases. In order to attain a high speech quality, it is desirable that the size of the inter-element waveform code book 7 is large. On the other hand, in order to attain a low bit rate, it is desirable that the bit number of the inter-element waveform information is small. Further, in order to attain a real-time operation of the encoder 1, it is desirable that the number of steps of calculation for the matching with the inter-element waveform code book 7 is small. Therefore, a desired inter-element waveform code book 7 has a small size and causes only a small encoding signal distortion.

The inter-element waveform code book 7 is prepared by use of a computer which operates in accordance with a program. The computer executes the following processes by referring to the program. A sufficiently great set of inter-element waveform samples is subjected to a clustering process such that the Euclidean distances between the centroid (the center of gravity) and the samples will be minimized. As a result of the clustering process, the set is separated into clusters, the number of which depends on the size of an inter-element waveform code book 7 to be formed. A final inter-element waveform code book 7 is formed by the centroids (the centers of gravity) of the clusters. The clustering process is of the cell division type. The clustering process has the following steps (1)–(8).

(1) The cluster number K is initialized to 1 as "K=1". The step (1) is followed by the step (2).

(2) The centroid or centroids of the K cluster or clusters are calculated by a simple mean process. For each of the clusters, the Euclidean distances between the centroid and all the samples in the cluster are calculated, and the maximum of the calculated Euclidean distances is set as a distortion of the cluster. The step (2) is followed by the step (3).

(3) Two new centroids are formed around the centroid of the cluster which is selected from the K cluster or clusters and which has the greatest distortion. The new centroids will constitute nuclei of cell division. The step (3) is followed by the step (4).

(4) A clustering process is done on the basis of the K+1 centroids, and centroids are re-calculated. The step (4) is followed by the step (5).

(5) When a null cluster or clusters are present, the centroid or centroids of the null cluster or clusters are erased and a return to the step (3) is done. In the absence of a null cluster, the step (5) is followed by the step (6).

(6) The distortions of the K+1 clusters are calculated similarly to the step (2). A variation in the sum of the calculated distortions is compared to a predetermined small threshold value. When the variation is equal to or smaller than the threshold value, the step (6) is followed by the step (7). When the variation is greater than the threshold, a return to the step (4) is done.

(7) When the number K+1 does not reach a target cluster number, the number K is incremented as "K=K+1" and a return to the step (2) is done. When the number K+1 reaches the target cluster number, the step (7) is followed by the step (8).

(8) The centroids of all the clusters are calculated, and a final inter-element waveform code book 7 is formed.

Figure 7:
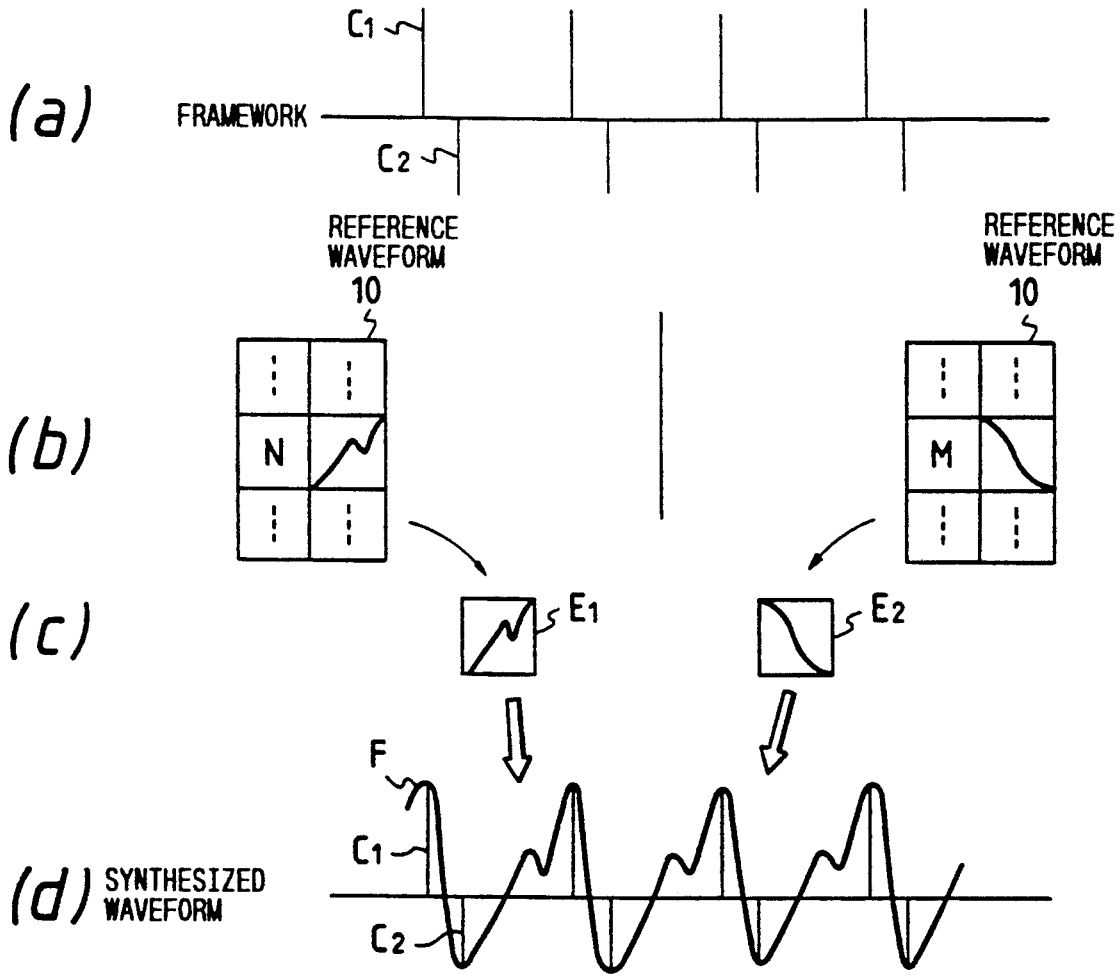
FIG. 7 is a diagram showing examples of processes executed in the decoder of FIG. 1.

A decoder 2 includes a framework forming section 8, a waveform synthesizer 9, and an inter-element waveform code book 10. The decoder 2 will be further described with reference to FIG. 7 showing an example with a frame degree equal to 1.

The framework forming section 8 includes a digital signal processor having a processing section, a ROM, and a RAM. The framework forming section 8 executes hereinafter-described processes in accordance with a program stored in the ROM. The framework forming section 8 receives the pitch information from the pitch analyzer 4 within the encoder 1, and also receives the framework information from the framework search section 5 within the encoder 1. The framework forming section 8 forms elements C1 and C2 of a framework on the basis of the received pitch information and the received framework information. The formed elements C1 and C2 of the framework are shown in the part (a) of FIG. 7.

The waveform synthesizer 9 includes a digital signal processor having a processing section, a ROM, and a RAM. The waveform synthesizer 9 executes hereinafter-described processes in accordance with a program stored in the ROM. The waveform synthesizer 9 receives the inter-element waveform information N and M from the inter-element waveform selector 6 within the encoder 1. The waveform synthesizer 9 selects basic inter-element waveforms E1 and E2 from waveform samples in the inter-element waveform code book 10 in response to the inter-frame waveform information N and M as shown in the part (b) of FIG. 7. The inter-element waveform code book 10 is equal in design and structure to the inter-element waveform code book 7 within the encoder 1. The waveform synthesizer 9 receives the framework elements C1 and C2 from the framework forming section 8. The waveform synthesizer 9 converts the selected basic inter-element waveforms E1 and E2 in time base and power in dependence on the framework elements C1 and C2 so that the resultant inter-element waveforms will be extended between the framework elements C1 and C2 to synthesize and retrieve a final waveform F as shown in the parts (c) and (d) of FIG. 7. The synthesized waveform F is used as an output speech signal 11.

Simulation experiments were performed as follows. Speech data to be encoded originated from a female announcer's weather forecast Japanese speech which was expressed in Japanese Romaji characters as "Tenkiyohou. Kishouchou yohoubu gogo 1 ji 30 pun happyo no tenkiyohou o oshirase shimasu. Nihon no nangan niwa, touzai ni nobiru zensen ga teitaishi, zensenjou no Hachijojima no higashi ya, Kitakyushuu no Gotou Rettou fukin niwa teikiatsu ga atte, touhokutou ni susunde imasu". Specifically, the original Japanese speech was converted into an electric analog signal, and the analog signal was sampled at a frequency of 8 kHz and the resulting samples were converted into corresponding digital speech data. The duration of the original Japanese speech was about 20 seconds. The speech data were analyzed for each frame having a period of 20 milliseconds. A set of inter-element waveform samples was obtained by analyzing speech data which originated from 10-second speech spoken by 50 males and females different from the previously-mentioned female announcer. The inter-element waveform code books 7 and 10 were formed on the basis of the set of the inter-element waveform samples in accordance with a clustering process. The total number of the inter-element samples was equal to about 20,000.

The upper limit of the framework degree was set to 3. In order to further decrease the bit rate, the bit assignment was done adaptively in dependence on the framework degree. The 2-degree framework position information, the 3-degree framework position information, and the 3-degree framework gain information were encoded by referring to the inter-element waveform code book 7 and by using a plurality of pieces of information as vectors. This encoding of the information was similar to the encoding of the inter-element waveforms. This encoding of the information was to save the bit rate. The size of the inter-element waveform code book 7 for obtaining the inter-element waveform information was varied adaptively in dependence on the framework degree and the length of the waveform, so that a short waveform was encoded by referring to a small inter-element waveform code book 7 and a long waveform was encoded by referring to a large inter-element waveform code book 7. The bit assignment per speech data unit (20 milliseconds) was designed as shown in FIG. 8.

From the results of the experiments of the encoding which were performed under the previously-mentioned conditions, it was found that a smooth and natural speech was synthesized in spite of a low bit rate. An S/N ratio of about 10 dB was obtained. Similar experiments were done with respect to speeches other than the previously-mentioned Japanese speech. From the results of these experiments, it was also confirmed that S/N ratios of 7–11 dB were obtained and that speech qualities were good.

DESCRIPTION OF THE SECOND PREFERRED EMBODIMENT

Figure 9:
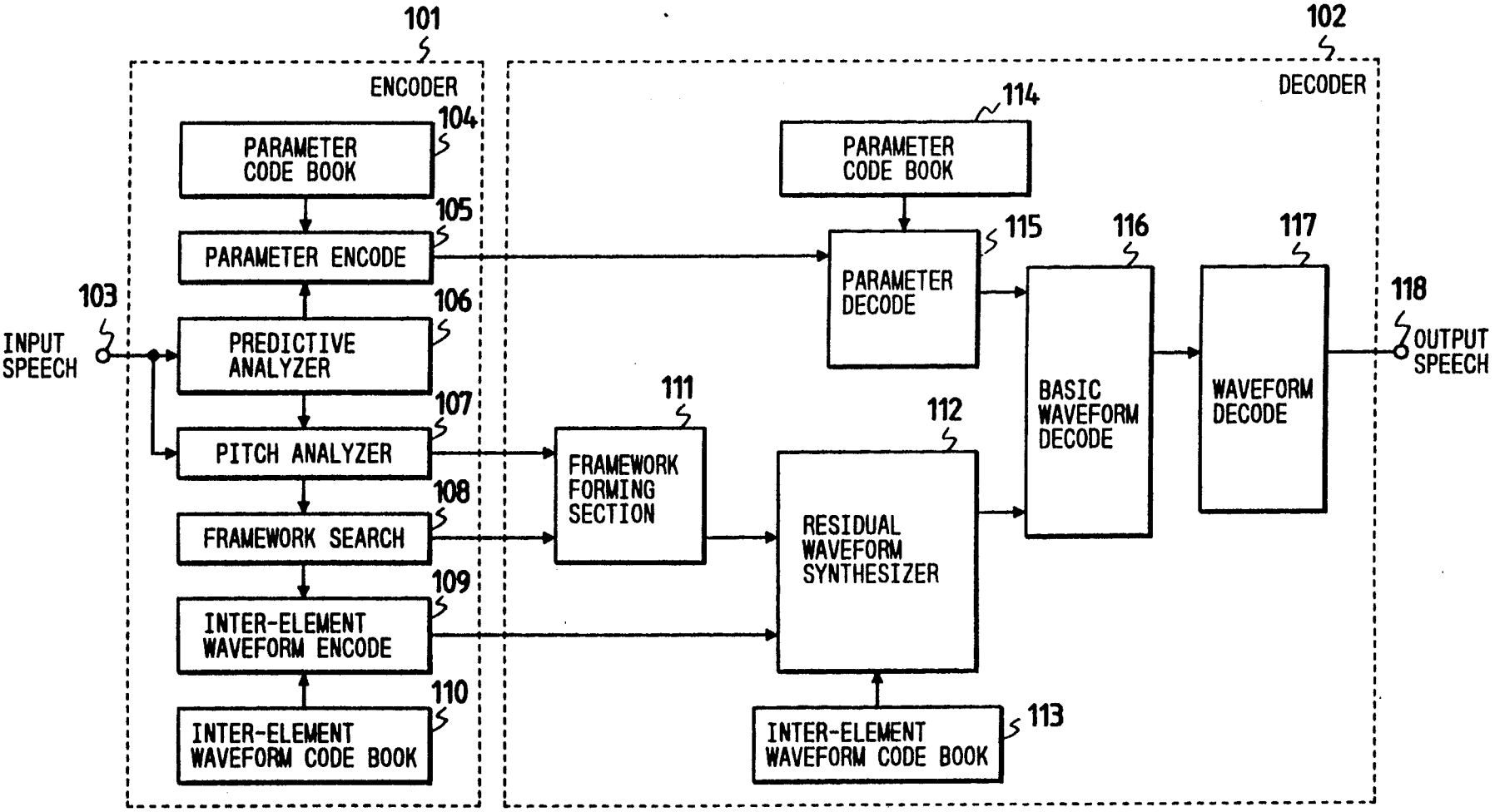
FIG. 9 is a block diagram of an encoder and a decoder according to a second embodiment of this invention.

With reference to FIG. 9, an encoder 101 receives a digital speech signal 103 from an analog-to-digital converter (not shown) which samples an analog speech signal, and which converts samples of the analog speech signal into corresponding digital data. The digital speech signal 103 includes a sequence of separated frames each having a predetermined time length.

The encoder 101 includes an LSP parameter code book 104, a parameter encoding section 105, and a linear predictive analyzer 106. The linear predictive analyzer 106 subjects the digital speech signal 103 to a linear predictive analysis, and thereby calculates linear predictive coefficients for each frame. The parameter encoding section 105 converts the calculated linear predictive coefficients into LSP parameters having good characteristics for compression and interpolation. Further, the parameter encoding section 105 vector-quantizes the LSP parameters by referring to the parameter code book 104, and transmits the resultant data to a decoder 102 as parameter information.

The parameter code book 104 contains predetermined LSP parameter references. The parameter code book 104 is provided in a storage device such as a ROM. The parameter code book 104 is prepared by use of a computer which operates in accordance with a program. The computer executes the following processes by referring to the program. Various types of speeches are subjected to a linear predictive analysis, and thereby a population of LSP parameters is formed. The population of the LSP parameters is subjected to a clustering process such that the Euclidean distances between the centroid (the center of gravity) and the samples will be minimized. As a result of the clustering process, the population is separated into clusters, the number of which depends on the size of a parameter code book 104 to be formed. A final parameter code book 104 is formed by the centroids (the centers of gravity) of the clusters. This clustering process is similar to the clustering process used in forming the inter-element waveform code book 7 in the embodiment of FIGS. 1–8.

The encoder 101 includes a pitch analyzer 107, a framework search section 108, an inter-element waveform encoding section 109, and an inter-element waveform code book 110. The pitch analyzer 107 detects the pitch within each frame of the digital speech signal 103. The pitch analyzer 107 generates pitch information representing the detected pitch within each frame. The pitch analyzer 107 transmits the pitch information to the decoder 102. The pitch analyzer 107 derives an average waveform of one pitch from the waveform of each frame. The average waveform is referred to as a basic waveform. The pitch analyzer 107 subjects the basic waveform to a filtering process using the linear predictive coefficients fed from the linear predictive analyzer 106, so that the pitch analyzer 107 derives a basic residual waveform of one pitch. The pitch analyzer 107 feeds the basic residual waveform to the framework search section 108.

The framework search section 108 analyzes the shape of the basic residual waveform, and decides what degree a framework (skeleton) to be constructed has. The degree of a framework is defined as being equal to a half of the total number of elements of the framework. It should be noted that the elements of the framework form pairs as will made clear later. The framework search section 108 searches signal time points, at which the absolute value of positive signal data and the absolute value of negative signal data are maximized, in dependence on the degree of the framework. The framework search section 108 defines the searched signal points and the related signal values as framework information (skeleton information). The framework search section 108 feeds the framework information to the inter-element waveform encoding section 109 and the decoder 102. The framework search section 108 is basically similar to the framework search section 5 in the embodiment of FIGS. 1–8.

The inter-element waveform encoding section 109 includes a digital signal processor having a processing section, a ROM, and a RAM. The inter-element waveform encoding section 109 executes the following processes in accordance with a program stored in the ROM. Firstly, the inter-element waveform encoding section 109 decides basic inter-element waveforms within one pitch on the basis of the framework information fed from the framework search section 108. The basic inter-element waveforms agree with waveform segments which extend between the elements of the basic residual waveform. Secondly, the basic inter-element waveforms are normalized in time base and power. During the normalization, the ends of the basic inter-element waveforms are fixed. The inter-element waveform encoding section 109 compares the normalized waveforms with predetermined inter-element waveform samples which are identified by different numbers respectively. By referring to the results of the comparison, the inter-element waveform encoding section 109 selects at least two of the inter-element waveform samples which are closest to the normalized waveforms. The inter-element waveform encoding section 109 outputs the identification numbers of the selected inter-element waveform samples as inter-element waveform information. The inter-element waveform encoding section 109 is basically similar to the inter-element waveform selector 6 in the embodiment of FIGS. 1–8.

The inter-element waveform samples are stored in the inter-element waveform code book 110, and are read out by the inter-element waveform encoding section 109. The inter-element waveform code book 110 is provided in a storage device such as a ROM. The inter-element waveform samples are predetermined as follows. Various types of speeches are analyzed, and basic inter-element waveforms of many kinds are obtained. The basic inter-element waveforms are normalized in time base and power into inter-element waveform samples which are identified by different numbers respectively. The inter-element waveform code book 110 is similar to the inter-element waveform code book 7 in the embodiment of FIGS. 1-8.

The decoder 102 includes a framework forming section 111, a basic residual waveform synthesizer 112, and an inter-element waveform code book 113. The decoder 102 will be further described with reference to FIG. 9 and FIG. 10 which shows an example with a frame degree equal to 1.

The framework forming section 111 includes a digital signal processor having a processing section, a ROM, and a RAM. The framework forming section 111 executes hereinafter-described processes in accordance with a program stored in the ROM. The framework forming section 111 receives the pitch information from the pitch analyzer 107 within the encoder 101, and also receives the framework information from the framework search section 108 within the encoder 101. The framework forming section 111 forms elements C1 and C2 of a framework on the basis of the received pitch information and the received framework information. The formed elements C1 and C2 of the framework are shown in the upper part of FIG. 10.

Figure 10:
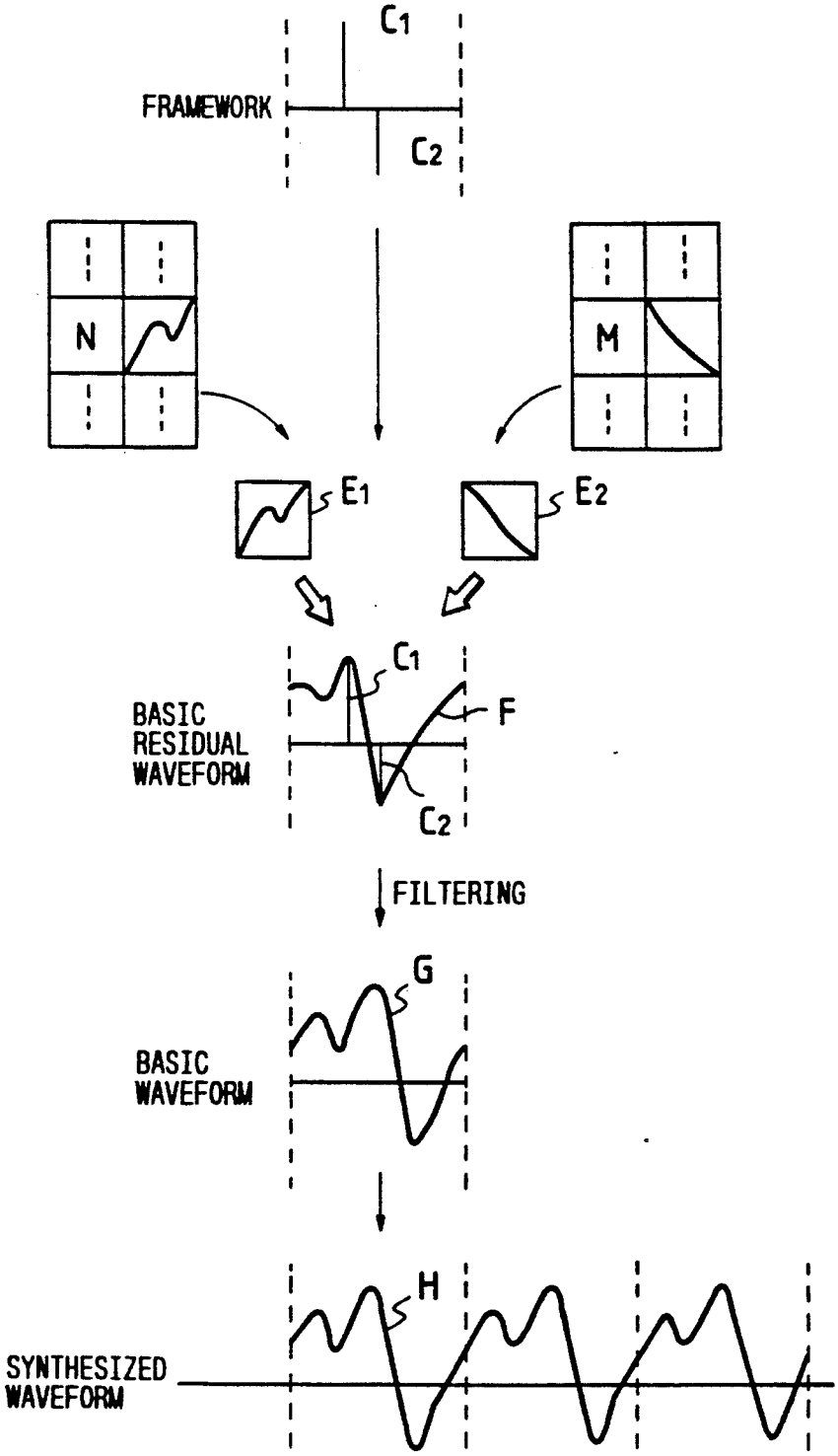
FIG. 10 is a diagram showing examples of processes executed in the decoder of FIG. 9.

The basic residual waveform synthesizer 112 includes a digital signal processor having a processing section, a ROM, and a RAM. The basic residual waveform synthesizer 112 executes hereinafter-described processes in accordance with a program stored in the ROM. The basic residual waveform synthesizer 112 receives the inter-element waveform information N and M from the inter-element waveform encoding section 109 within the encoder 101. The basic residual waveform synthesizer 112 selects basic inter-element waveforms E1 and E2 from waveform samples in the inter-element waveform code book 113 in response to the inter-frame waveform information N and M as shown in FIG. 10. The inter-element waveform code book 113 is equal in design and structure to the inter-element waveform code book 110 within the encoder 101. The basic residual waveform synthesizer 112 receives the framework elements C1 and C2 from the framework forming section 111. The basic residual waveform synthesizer 112 converts the selected basic inter-element waveforms E1 and E2 in time base and power in dependence on the framework elements C1 and C2 so that the resultant inter-element waveforms will be extended between the framework elements C1 and C2 to synthesize and retrieve a basic residual waveform F as shown in the intermediate part of FIG. 10.

The decoder 102 includes an LSP parameter code book 114, a parameter decoding section 115, a basic waveform decoding section 116, and a waveform decoding section 117. The parameter decoding section 115 receives the parameter information from the parameter encoding section 105 within the encoder 101. The parameter decoding section 115 selects one of sets of LSP parameters in the parameter code book 114 in response to the parameter information. The parameter decoding section 115 feeds the selected LSP parameters to the basic waveform decoding section 116. The parameter code book 114 is equal in design and structure to the parameter code book 104 within the encoder 101.

The basic waveform decoding section 116 receives the basic residual waveform from the basic residual waveform synthesizer 112. The basic waveform decoding section 116 subjects the basic residual waveform to a filtering process using the LSP parameters fed from the parameter decoding section 115. Thus, the basic residual waveform F is converted into a corresponding basic waveform G as shown in FIG. 10. The basic waveform decoding section 116 outputs the basic waveform G to the waveform decoding section 117. The waveform decoding section 117 multiplies the basic waveform G, and arranges the basic waveforms G into a sequence which extends between the ends of a frame. As shown in FIG. 10, the sequence of the basic waveforms G constitutes a finally-retrieved speech waveform H. The finally-retrieved speech waveform H is used as an output signal 118.

Simulation experiments were performed as follows. Speech data to be encoded originated from a female announcer's weather forecast Japanese speech which was expressed in Japanese Romaji characters as "Tenkiyohou. Kishouchou yohoubu gogo 1 ji 30 pun happyo no tenkiyohou o oshirase shimasu. Nihon no nangan niwa, touzai ni nobiru zensen ga teitaishi, zensenjou no Hachijojima no higashi ya, Kitakyushuu no Gotou Rettou fukin niwa teikiatsu ga atte, touhokutou ni susunde imasu". Specifically, the original Japanese speech was converted into an electric analog signal, and the analog signal was sampled at a frequency of 8 kHz and the resulting samples were converted into corresponding digital speech data. The duration of the original Japanese speech was about 20 seconds. The speech data were analyzed for each frame having a period of 20 milliseconds. The window of this analyzation was set to 40 milliseconds. The order of the linear predictive analysis was set to 10. The LSP parameters were searched by using 128 DFTs. The size of the parameter code books 104 and 114 was set to 4,096. A set of inter-element waveform samples was obtained by analyzing speech data which originated from 10-second speech spoken by 50 males and females different from the previously-mentioned female announcer. The inter-element waveform code books 110 and 113 were formed on the basis of the set of the inter-element waveform samples in accordance with a clustering process. The total number of the inter-element samples was equal to about 20,000.

In the framework search section 108, the upper limit of the framework degree was set to 3. The 2-degree framework position information, the 3-degree framework position information, and the 3-degree framework gain information were encoded by referring to the inter-element waveform code book 110 and by using a plurality of pieces of information as vectors. This encoding of the information was similar to the encoding of the inter-element waveforms. This encoding of the information was to save the bit rate. In order to further decrease the bit rate, the bit assignment was done adaptively in dependence on the framework degree. The size of the inter-element waveform code book 110 for obtaining the inter-element waveform information was varied adaptively in dependence on the framework degree and the length of the waveform, so that a short waveform was encoded by referring to a small inter-element waveform code book 110 and a long waveform was encoded by referring to a large inter-element waveform code book 110.

In the waveform decoding section 117 within the decoder 102, the basic waveforms were arranged by use of a triangular window of 40 milliseconds so that they were smoothly joined to each other.

The bit assignment per speech data unit (20 milliseconds) was designed as shown in FIG. 11.

From the results of the experiments of the encoding which were performed under the previously-mentioned conditions, it was found that a smooth and natural speech was synthesized in spite of a low bit rate. An S/N ratio of about 10 dB was obtained. Similar experiments were done with respect to speeches other than the previously-mentioned Japanese speech. From the results of these experiments, it was also confirmed that S/N ratios of 5–10 dB were obtained and that speech qualities were good. Especially, high articulations were obtained.

What is claimed is:

1. A speech encoding apparatus comprising:

means for analyzing a pitch of an input speech signal, deriving a basic waveform of a single pitch of the input speech signal and representing a frame of the input speech signal by said basic waveform of a single pitch;

means for deciding a number of a pair or pairs of pulse elements of a desired framework representing the basic waveform of the single pitch of the input speech signal, and generating the desired framework in response to the basic waveform;

means for encoding the generated desired framework;

an inter-element waveform code book containing predetermined inter-element waveform samples which are identified by different identification numbers; and means for encoding inter-element waveforms which extend between the elements of the framework by use of the inter-element waveform code book.

2. The speech encoding apparatus of claim 1 wherein the inter-element waveform code book includes stored inter-element waveform samples with respective identification numbers thereof, and is formed by analyzing speech signals of different types, thereby obtaining original inter-element waveforms of different types, normalizing the original inter-element waveforms in the base and power into the inter-element waveform samples while fixing ends of the original inter-element waveforms, attaching the identification numbers to the inter-element waveform samples respectively, and storing the inter-element waveform samples with the identification numbers.

3. A decoding apparatus comprising:

means for decoding framework coded information into a framework composed of pulse elements;

an inter-element waveform code book containing predetermined inter-element waveform samples which are identified by different identification numbers; and means for decoding inter-element waveform coded information into inter-element waveforms by use of the inter-element waveform code book, the inter-element waveforms extending between the elements of the framework.

4. The decoding apparatus of claim 3 wherein the inter-element waveform code book includes stored inter-element waveform samples with respective identification members thereof, and is formed by analyzing speech signals of different types, thereby obtaining original inter-element waveforms of different types, normalizing the original inter-element waveforms in time base and power into the inter-element waveform samples while fixing ends of the original inter-element waveforms, attaching the identification numbers to the inter-element waveform samples respectively, and storing the inter-element waveforms samples with the identification numbers.

5. A speech encoding apparatus comprising:

means for deriving an average of waveforms of single pitches of an input speech signal which occurs during a predetermined interval;

means for deciding a framework of the average one-pitch waveform, the framework being composed of elements corresponding to pulses respectively;

means for encoding the framework;

means for deciding inter-element waveforms in response to the framework, the inter-element waveforms extending between the elements of the framework; and means for encoding the inter-element waveforms.

6. A speech encoding apparatus comprising:

means for deriving an average of waveforms within one pitches of an input speech signal which occurs during a predetermined interval;

means for deciding a framework of the average one-pitch waveform, the framework being composed of elements corresponding to pulses respectively which occur at time points equal to time points of occurrence of minimal and maximal levels of the average one-pitch waveforms, and which have levels equal to the minimal and maximal levels of the average one-pitch waveform;

means for encoding the framework;

means for deciding inter-element waveforms in response to the framework, the inter-element waveforms extending between the elements of the framework; and means for encoding the inter-element waveforms.

7. A speech encoding apparatus comprising:

means for separating an input speech signal into predetermined equal-length intervals, executing a pitch analysis of the input speech signal for each of the analysis intervals to obtain pitch information, and deriving a basic waveform of a one-pitch length which represents the analysis intervals by use of the pitch information;

means for executing a linear predictive analysis of the input speech signal, and extracting linear predictive parameters denoting frequency characteristics of the input speech signal for each of the analysis intervals;

means for subjecting the basic waveform to a filtering process in response to the linear predictive parameters, and deriving a linear predictive residual waveform of a one-pitch length;

means for deriving a framework denoting a shape of the predictive residual waveform, and encoding the derived framework, the framework being composed of elements corresponding sequential pulses of different types;

an inter-element waveform code book containing predetermined inter-element waveform samples which are identified by different identification numbers; and means for encoding inter-element waveform which extend between the elements of the framework by use of the inter-element waveform code book.

8. The speech encoding apparatus of claim 7 wherein the inter-element waveform code book includes stored inter-element waveform samples with respective identification numbers thereof, and is formed by analyzing speech signals of different types, thereby obtaining original inter-element waveforms of different types, normalizing the original inter-element waveform in time base and power into the inter-element waveform samples while fixing ends of the original inter-element waveform, attaching the identification numbers to the inter-element waveform samples respectively, and storing the inter-element waveform samples with the identification numbers.

9. A decoding apparatus comprising:

means for decoding framework coded information into a framework composed of elements corresponding sequential pulses;

an inter-element waveform code book containing predetermined inter-element waveform samples which are identified by different identification numbers;

means for decoding inter-element waveform coded information into inter-element waveforms by use of the inter-element waveform code book, and forming a basic predictive residual waveform, the inter-element waveforms extending between the elements of the framework;

means for subjecting the basic predictive residual waveform to a filtering process in response to input parameters, and deriving a basic waveform of a one-pitch length; and means for retrieving a final waveform of a one-pitch length on the basis of the basic one-pitch waveform.

10. The decoding apparatus of claim 9 wherein the inter-element waveform code book includes stored inter-element waveform samples with respective identification numbers thereof, and is formed by analyzing speech signals of different types, thereby obtaining original inter-element waveforms of different types, normalizing the original inter-element waveforms in time base and power into the inter-element waveform samples while fixing ends of the original inter-element waveforms, attaching the identification numbers to the inter-element waveform samples respectively, and storing the inter-element waveform samples with the identification numbers.

11. A speech encoding apparatus according to claim 1, wherein said means for deciding selects only a single pair of pulse elements for the framework representing the basic waveform of the single-pitch of the input speech signal, and said means for encoding inter-element waveforms operates for encoding only a single pair of said inter-element waveforms by using identification numbers therefor from said code book, thereby generating the desired framework to include only said single pair of pulse elements and a single pair of identification numbers from said code book, whereby said speech encoding apparatus encodes an entire frame of said input speech signal as a code representing only said single pair of pulse elements and said single pair of said inter-element waveform identification numbers from said code book representing the basic waveform of said single pitch thereof.

12. A speech encoding apparatus according to claim 1, wherein said meams for deciding selects a predetermined number of pairs of pulse elements, less than a total number of pairs of maxima and minima in a frame of the input speech signal, for the framework representing the basic waveform of the single-pitch of the input speech signal, and said means for encoding inter-element waveforms operates for encoding only a single pair of said inter-element waveforms for each of said predetermined number of pairs of pulse elements, by using identification numbers therefor from said code book, thereby generating the desired framework to include only said predetermined number of pulse element pairs and a single pair of identification numbers from said code book for each said pair, whereby said speech encoding apparatus encodes an entire frame of said input speech signal as a code representing only said predetermined number of pairs of pulse elements, less than said total number of pairs of maxima and minima, and a corresponding number of pairs of said inter-element waveform identification numbers from said code book.

* * * * *